US005444961A

United States Patent [19]

Doane et al.

[11] Patent Number: 5,444,961

[45] Date of Patent: Aug. 29, 1995

[54] HIGH THROUGHPUT, LOW COST, NON-IMPACT PRINTING

[75] Inventors: I. Gerald Doane; John Van de Ven, both of Grand Island, N.Y.

[73] Assignee: Moore Business Forms, Inc., Grand Island, N.Y.

[21] Appl. No.: 909,014

[22] Filed: Jul. 6, 1992

[51] Int. Cl.[6] ..... B65B 35/50; B65B 61/02; B65B 63/04

[52] U.S. Cl. ..... 53/411; 53/429; 53/447; 53/131.4; 53/117; 53/540

[58] Field of Search ..... 53/131.2, 131.4, 373.2, 53/375.4, 284.3, 411, 414, 429, 447, 455, 480, 476, 138.6, 117, 139.4, 540, 562, 460; 493/187, 188, 320; 270/1.1, 54

[56] References Cited

U.S. PATENT DOCUMENTS

| | | | |
|---|---|---|---|
| 2,746,221 | 5/1956 | Rouan et al. | 53/460 |
| 3,511,013 | 5/1970 | Pahlitzsch | 53/455 X |
| 3,911,818 | 10/1975 | MacIlvaine | 101/52 X |
| 3,983,679 | 10/1976 | Zemke | 53/284.3 X |
| 4,443,211 | 4/1984 | Wooley | 493/188 |
| 4,649,691 | 3/1987 | Buckholz | 53/284.3 X |
| 4,739,606 | 4/1988 | Cantile | 53/131.2 X |
| 4,883,220 | 11/1989 | Brown | 493/187 X |
| 4,989,852 | 2/1991 | Gunther | 270/54 X |

*Primary Examiner*—Linda Johnson
*Attorney, Agent, or Firm*—Nixon & Vanderhye

[57] ABSTRACT

A method and apparatus are capable of producing sealed mailers from sheets of paper at speeds in excess of 200 documents per minute (e.g. 400 documents per minute or more) in an inexpensive manner, including by variably non-impact duplex printing the faces of each sheet with up to thirty six lines of variable data with each line up to ten inches long. The sheets are fed one at a time from a stack and then immediately aligned. Immediately after alignment the first face of each sheet is ink jet printed with variable data, the sheets are inverted and then immediately the second face of each sheet is ink jet printed with variable data. The printed sheets are immediately folded, and if they have adhesive (such as pressure activated adhesive) they are immediately sealed. They may then be sorted, stacked, and tied into bundles. Control of all of the operations is provided by a central computer control which ensures that the processing speed is consistent throughout. The method is particularly suited for producing simple mailer type business forms such as IRS 1099 forms, statements, notices, and advertisements.

20 Claims, 2 Drawing Sheets

HIGH THROUGHPUT, LOW COST, NON-IMPACT PRINTING

BACKGROUND AND SUMMARY OF THE INVENTION

There are a number of prior art systems and methods that are used for producing mailers or other types of business forms that imprint the forms with variable data, such as addresses. Prior art systems, almost regardless of their complexity, typically run at speeds of only about 100–130 documents per minute. Common systems are simple addressing machines which cost in the neighborhood of 35,000 to 40,000 1992 U.S. dollars. More sophisticated machines, such as the Kodak Diconix Digit: System (which can print only on one side) typically cost in the neighborhood of about 750,000 1992 U.S. dollars. The prior art has failed to fill a need by many business forms processors, including companies doing large mailings, for a cost effective and high volume method and system.

According to the present invention the need, unfulfilled by the prior art, for a cost effective high speed business forms handling system that is capable of variable duplex non-impact printing has been fulfilled. According to the present invention it is possible to process flexible sheets (e.g. paper) at speeds in excess of 200 documents per minute, and in fact at speeds of about 400 documents per minute or more, so that they are duplex printed, folded, and in fact even sealed and otherwise made fully ready for mailing or other disposition. The invention is capable of achieving these results at a modest cost, all of the equipment for achieving these desirable results being available for about 50,000–100,000 1992 U.S. dollars. Since the equipment according to the present invention is able to produce final business forms at speeds approaching four times that of the prior art systems, it is extremely cost effective.

According to one aspect of the present invention, a method of continuously, in immediate succession, transforming flexible sheets into folded business forms at speeds in excess of 200 documents per minute is provided. The method comprises the steps of continuously and sequentially: (a) Feeding sheets, having first and second faces, one at a time from a stack in a first direction. Then immediately (b) aligning the sheets. Then immediately (c) non-impact printing the first face of each of the sheets. Then immediately (d) inverting the sheets. Then immediately (e) non-impact printing the second face of each of the sheets, at least one of steps (d) and (f) practiced to print variable data. Then (f) folding the sheets to produce printed, folded business forms. Each of steps (a)–(f) is practiced at essentially the same speed, and in excess of 200 documents per minute.

There is also preferably the further step (g) of, immediately after step (e) at essentially the same speed as steps (a) through (f), rotating each of the documents about 90°, about a vertical axis, then immediately practicing step (f). When the sheets of paper have adhesive patterns (such as pressure activated adhesive such as that sold by Topan-Moore under the designation "TN 124", see U.S. Pat. No. 4,918,128 ) there is preferably the further step (h), immediately after step (f), of sealing the folded sheets into mailers by applying pressure to the pressure activated adhesive patterns, step (h) being practiced at essentially the .same speed as steps (a)–(g).

While a number of non-impact technologies are available for effecting simplex or duplex printing according to the invention, it is desirable that both steps (a) and (c) are practiced by ink jet printing, up to thirty six lines of variable information up to ten inches long each, on each sheet. While the invention achieves high speeds and in a cost effective manner, because of the high speed it is not possible to produce high quality printing or full page coverage. However there are large numbers of classes of business forms, such as 1099 forms, statements, notices, and advertisements, for which the invention is ideally suited.

When practicing the present invention, the sheets that are acted upon are typically single ply sheets, although the term "sheet" as used in the specification and claims also covers two or multiple ply sheets. Also, it is of course within the scope of the present invention to, if simplex printing is all that is required for a particular form, to deactivate the inverter and the second ink jet printer. All of the operations are preferably controlled with a computer, and the documents continuously advanced in an essentially straight line, first, horizontal direction throughout the practice of the method steps.

According to another aspect of the present invention a method of producing business forms with up to thirty six lines of variable data, each line up to about ten inches long, at a speed of about 400 documents per minute or more, is provided. The method comprises the steps of continuously and immediately sequentially, and while moving the documents in substantially the same horizontal direction throughout: (a) Feeding sheets of paper one at a time from a stack. (b) Aligning the sheets. (c) Ink jet printing the first face of each of the sheets with up to about thirty six lines of variable data, each line up to about ten inches long. (d) Inverting the sheets. (e) Ink jet printing the second face of each of the sheets with up to about thirty six lines of variable data, each line up to about ten inches long. (f) Rotating each of the documents about 90° about a vertical axis. And, (g) folding the sheets to produce printed, folded business forms. Each of steps (a)–(g) is practiced at essentially the same speed, and at about 400 documents per minute or more.

The invention also relates to a mechanically, electrically, and control-integrated system which comprises a plurality of components physically located immediately adjacent each other, in sequence. Each of the components is capable of performing its function at a speed of greater than 200 documents per minute (typically about 400 documents per minute or greater). The components provided are: A sheet feeder. A sheet aligner for accepting the sheets from the sheet feeder and accurately aligning them. A first non-impact print section for printing sheets fed from the sheet aligner with variable data. An inverter for inverting sheets discharged by the first print section. A second non-impact print section for printing sheets from the inverter with variable data. And, a folder for folding printed sheets. The system also comprises a computer control for controlling all of the components so that they operate at approximately the same speed, greater than 200 documents per minute.

The system preferably also comprises a forms rotator disposed between the second print section and the folder for rotating documents from the second print section approximately 90° about a vertical axis, and also typically comprises a sealer disposed immediately after the folder. The entire system costs less than 100,000 1992 U.S. dollars (e.g. about $50,000–$100,000).

It is the primary object of the present invention to provide a cost effective high speed method and system for transforming flexible sheets into variably printed folded business forms. This and other objects of the invention will become clear from an inspection of the detailed description of the invention and from the appended claims.

DETAILED DESCRIPTION OF THE DRAWINGS

Figure 1:
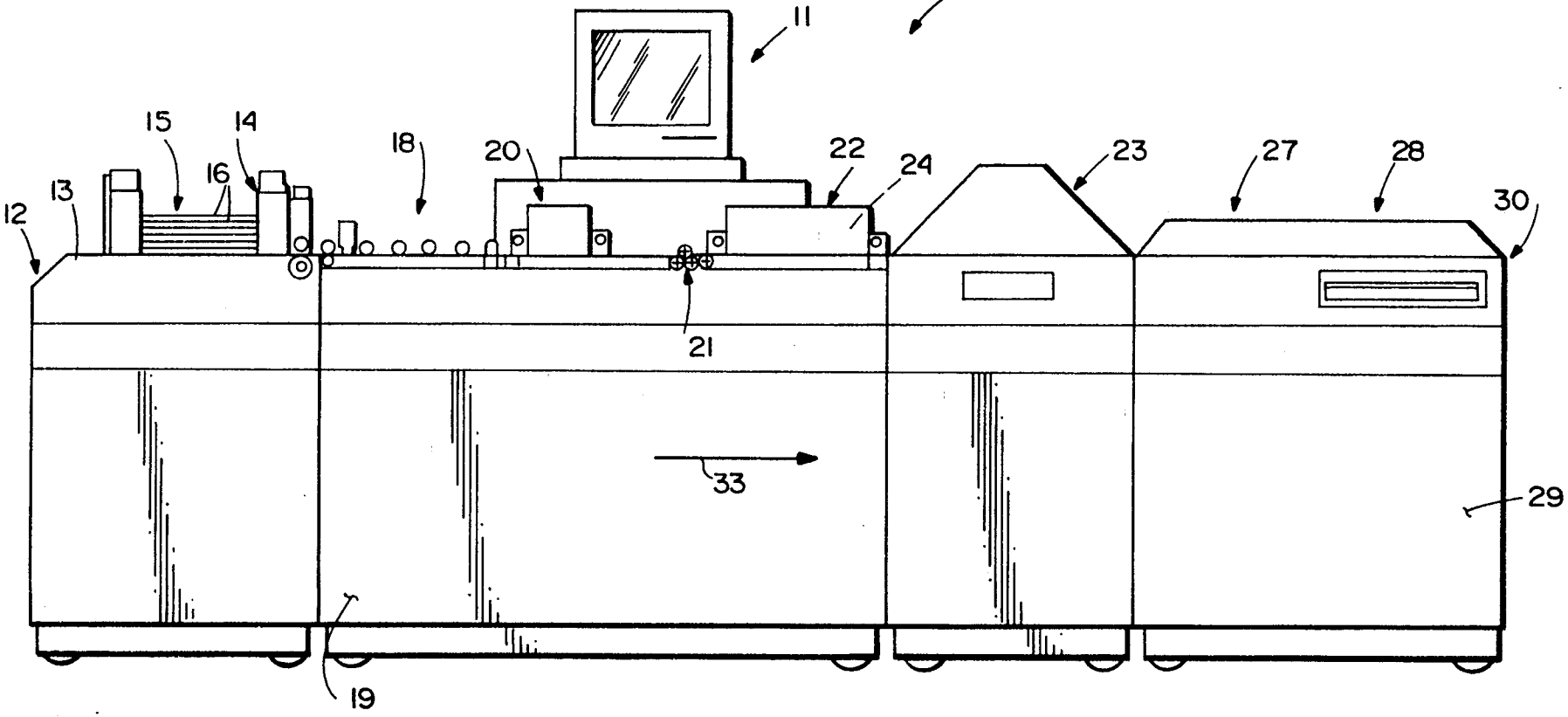
FIG. 1 is a side view of the exterior of exemplary components for the practice of the present invention.

Exemplary components of a system according to the present invention, the system being shown generally by reference numeral 10, are illustrated in FIG. 1. One advantage of the system 10 according to the invention is that all of the components thereof are per se known and commercially available. However the integration of these particular components into a unitary, mechanically, electrically and control-integrated system that is able to process sheets into variably printed business forms at speeds in excess of 200 documents per minute is a dramatic departure from the prior art. The invention is particularly suited for producing simple mailer type business forms such as IRS 1099 forms, statements, notices, and advertisements.

The components of the system 10 illustrated in FIG. 1 are mechanically connected together in-line, each component being immediately adjacent the previous component. Also the components of the system 10 (although not illustrated in the drawings) are electrically connected, and are also controlled by a central computer control, shown generally by reference numeral 11. The computer control may comprise the proprietary XL Data System, and associated computer control components, sold by Moore Business Forms, Inc. of lake Forest, Ill. (hereafter "Moore").

The first of the components, starting from the input end 12 of the system 10, is the sheet feeder 13, which has a tray 1 for receipt of a stack 15 of sheets/documents 16. The sheets/documents 16 are flexible, and typically of paper, and normally are single ply sheets, although two ply and multiple ply sheets are also capable of being acted upon according to the invention. The sheet feeder 13 must be capable of feeding sheets at a rate of 24,000 sheets per hour. One specific example of a commercially available sheet feeder 13 that has this capability and also may be electrically and control-integrated into the system 10 is a Burko Graphics BK15 feeder.

Connected to the feeder 13 is a sheet aligner 18 for accepting the sheets 16 from the sheet feeder 13 and accurately aligning them. The sheet aligner 18 can also perform a scanning function at the same time, to scan each successive sheet 16 for indicia that are used to effect subsequent controls, such as sorting, or even the printing operations themselves. The forms aligner 18 may be of a type available from Moore, and in basic concept is shown in co-pending application Ser. No. 07/604,858 filed Oct. 26, 1990.

Immediately adjacent the sheet aligner 18, and in fact mounted within the same integral cabinet 19, is a first non-impact print section 20. While a number of different non-impact printers can be utilized, it is desirable to provide an ink jet printer for the print section 20. The ink jet printer is capable of printing up to thirty six lines of variable data, each line up to about ten inches long. The print section 20 is basically constructed as illustrated in U.S. Pat. No. 3,911,818 (the disclosure of which is hereby incorporated by reference herein) is controlled by the XL Data System controller 11. Typically the nozzle array in the ink jet print section 20 is the Trident Ultrajet Model 183-0715. In the print section 20, the documents are stabilized for printing, such as by using vacuum belts, and the print heads are mounted. Conventional sheet sensing and speed encoding also may be practiced. The number of characters printed per line depend upon the size of the font selected.

In a particularly desirable construction according to the invention, the ink jet printer section 20 utilizes twelve Trident print bars, each capable of printing three lines, and with thirty two addressable dot positions per bar, and three drops per dot. The vertical resolution is 96 dpl, and the resolution in the direction of paper travel (33) is 240/120 dpl. The bars are individually adjustable across sixteen inch paper widths, and have a speed capability of 208/416 documents per minute.

After the first face (which is determined by the desired final orientation of the sheet 16) of the document 16 is printed in the first print section 20 the document is passed to an inverter 21 for inverting the sheets and delivering them to a second print section 22. The inverter preferably is commercially available from Moore, and is controlled by the system 11 so that it may be deactivated and bypassed if simplex printing is ever desired instead of duplex printing. The print section 22 is basically the same as the first print section 20, that is an ink jet print section generally as disclosed in U.S. Pat. No. 3,911,818 and capable of printing about thirty six lines of variable data up to about ten inches long each, and at a speed of about 400 forms per minute or more.

After the cabinet 19 containing the components 11, 18, 20, 21, and 22, a folder 23 is preferably provided. The folder also must be capable of operating at the high speeds of the rest of the components and electrically and control-integrated into the system 10. One particular commercially available folder that may be utilized is a Mathias Bauerle folder. The folder 23 typically folds the printed document 16 into mailable packages.

Most commercially available folders 23 desirably receive the printed documents in a different orientation than they have when discharged from the second ink jet print section 22. Therefore there optionally is provided, built directly into the same unit 19 as the rest of the components illustrated in FIG. 1, and as specifically illustrated in FIG. 1 within the print section 22 (indicated by the dotted line 24) a forms rotator. The forms rotator 24 changes the orientation of the forms to prepare them for the folding operation in folder 23, typically rotating them about 90° about the vertical axis. The forms rotator 24 also may be of the type commercially available from Moore and in concept is shown in co-pending application Ser. No. 07/697,994 filed May 10, 1991.

Figure 2:
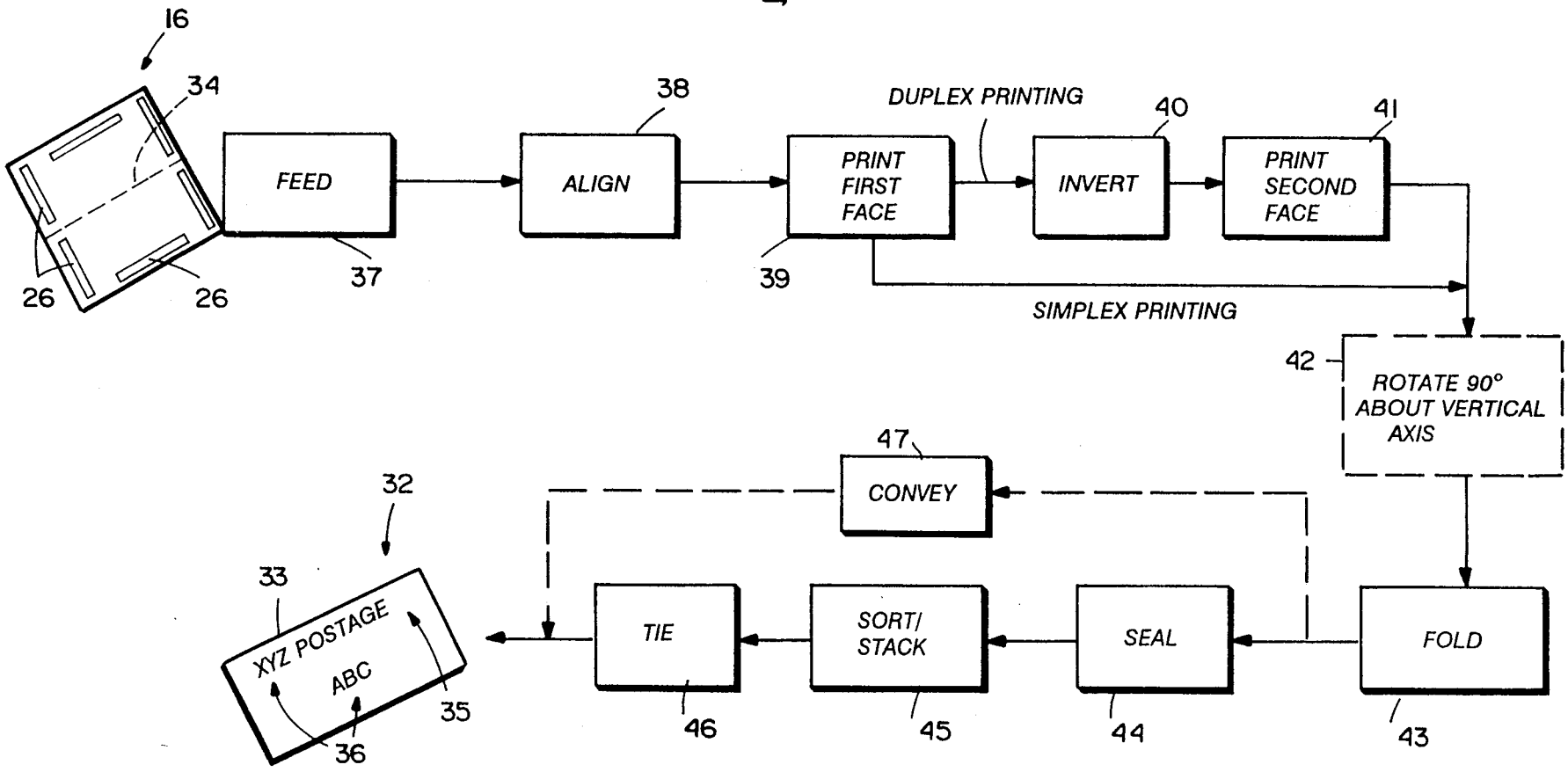
FIG. 2 is a schematic view illustrating the various method steps in the practice of the present invention.

Most often, it will also be desirable to seal the forms after folding, such as when mailers are being produced, In FIG. 2, one of the sheets 16 is shown with patterns of adhesive 26. Adhesive patterns are provided when the document 16 will be constructed into mailers. The adhesive patterns 26 may be of any conventional type of adhesive such as heat sealable adhesive or pressure activated adhesive. Preferably pressure activated adhesive, such as sold by Topan-Moore under the trade name "TN 124" is provided. Assuming this is so, the sealer 27 that forms part of the system 10 and is integrated with the rest of the components is a Moore pressure sealer. Typical sealers that can be utilized are Moore model numbers 4800, 4400 SR, and 4400 PK. In a sealing operation, the adhesive strips 26 are acted upon by rollers to apply a substantial pressure (e.g. 100 pounds per square inch) to effect the sealing action. The sealer 27 also is capable of producing sealed documents from the folder 23 at high speed, up to about 400 documents per minute or more.

If the forms are not sealed they are transported directly to a last section, shown schematically at 28 in FIG. 1, and in the same cabinet 29 as the sealer 27. The component 28 is either a delivery belt or another finishing system, such as an automatic sorter/stacker, wrapper, tying machine, or a series of such units. Ultimately, discharged from the output end 30 of the system 10 is a completed printed business form, such as the mailer 32 illustrated in FIG. 2.

Preferably, all of the components of the system 10 are disposed in line so that the document 16 continuously progresses in the horizontal direction indicated by arrow 33 in FIG. 1, although obviously the document is manipulated by moving in the direction 33 and occasionally moves out-of-plane, such as when it is inverted, folded, and/or rotated.

FIG. 2 schematically illustrates the method according to the present invention in which the various method steps implemented by the system 10 are practiced. As seen in the particular embodiment illustrated in FIG. 2, a single ply document 16 comprising a paper substrate with adhesive patterns 26 thereon (and having some non-variable data printed thereon), and a predetermined, or subsequently applied, score or fold line 34, is manipulated to produce the final mailer 32, which has variable data, such as the data 36, 35, printed thereon with the edges thereof sealed.

As illustrated in FIG. 2, the documents 16 are fed one at a time from the stack (15 in FIG. 1), as indicated by stage 37, then aligned as indicated by stage 38, and the first face thereof is variable printed, e.g. by ink jet printing, as indicated by stage 39. Assuming duplex printing, the document 16 is then inverted at stage 40, and the second face is preferably ink jet print with variable data, as illustrated at 41. Assuming simplex printing, the steps 40, 41 are bypassed.

At the inverting stage 40 the document 16 is rotated 180° about a horizontal axis perpendicular to direction 33 (see FIG. 1).

In order to accommodate most conventional folders (23), the next stage is typically the stage 42 in which the documents 16 are rotated approximately 90°, about a vertical axis. In any event, the printed documents are ultimately fed to stage 43 where they are folded. While in FIG. 2 a simple V fold is illustrated, of course the folding stage 43 can effect a wide variety of different folds, such as C folds, eccentric C folds, V folds, and Z folds.

Preferably, after the folding stage 43, the documents are passed to the sealing stage 44 where heat or pressure are applied so as to activate the strips of adhesive 26 and seal the document in the folded configuration—e.g. in the mailer 32 configuration. After sealing the documents may be automatically sorted and stacked, as illustrated at stage 45, and then tied into mailing bundles, as illustrated at 46. Alternatively, after folding at stage 43, the documents may be conveyed by a conveyor belt, indicated by stage 47, and either used merely in the folded condition, or otherwise processed at a different location.

The entire process schematically illustrated in FIG. 2 is practiced so that each of the stages 37 through 47 is performed at approximately the same speed, and that speed is in excess of 200 documents per minute, typically 400 documents per minute or more.

It will thus be seen that according to the present invention a cost effective high speed method and system have been provided for producing variably printed and folded (and preferably sealed) business forms in a continuous and sequential manner. While the invention has been shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and processes.

What is claimed is:

1. A method of continuously, in immediate succession, transforming flexible sheets into printed and folded business forms at speeds in excess of 200 documents per minute, comprising the steps of continuously and sequentially:

(a) feeding sheets, having first and second faces, one at a time from a stack in a first direction; then immediately (b) aligning the sheets; then immediately (c) non-impact printing the first face of each of the sheets; then immediately (d) inverting the sheets; then immediately (e) non-impact printing the second face of each of the sheets, at least one of steps (c) and (e) practiced to print variable data; then (f) folding the sheets to produce printed, folded business forms;

each of steps (a)–(f) being practiced at essentially the same speed, and in excess of 200 documents per minute.

2. A method as recited in claim 1 comprising the further step (g) of, immediately after step (e), at essentially the same speed as steps (a)–(f), rotating each of the documents about 90°, about a vertical axis, then immediately practicing step (f).

3. A method as recited in claim 2 wherein the sheets are of paper and have adhesive patterns thereon, and comprising the further step (h), immediately after step (f), of sealing the folded sheets into mailers by activating the adhesive patterns thereon, step (h) being practiced at essentially the same speed as steps (a)–(g) .

4. A method as recited in claim 3 wherein the sheets of paper have patterns of pressure activated adhesive thereon, and wherein step (h) is practiced by applying pressure to the pressure activated adhesive patterns.

5. A method as recited in claim 3 wherein steps (c) and (e) are practiced by ink jet printing of up to about thirty six lines of variable information up to about ten inches long each on each sheet.

6. A method as recited in claim 5 wherein steps (a)–(h) are practiced by centrally controlling each of the method steps using a computer.

7. A method as recited in claim 6 comprising the further step (i) of, immediately after step (h), sorting, stacking, and tying into bundles the completed mailers from step (h).

8. A method as recited in claim 7 wherein the sheets of paper have non-variable printing thereon, and wherein steps (a)–(i) are practiced to produce business forms selected from tile group consisting of IRS 1099 forms, statements, notices, and advertisements.

9. A method as recited in claim 1 wherein steps (c) and (e) are practiced to ink jet print both faces of each sheet with variable data.

10. A method as recited in claim 2 wherein steps (a)–(g) are each practiced at the same speed of about 400 documents per minute or more.

11. A method as recited in claim 2 wherein the documents continuously advance in the first direction throughout the practice of steps (a)–(g); and comprising the further step of selectively bypassing steps (d) and (e) for some documents.

12. A method of producing business forms with up to about thirty six lines of variable data, each line up to about ten inches long, at a speed of about 400 documents per minute or more, comprising the steps of continuously and immediately sequentially, and while moving a document in substantially the same horizontal direction throughout:

(a) feeding sheets of paper one at a time from a stack, each sheet having first and second opposite faces;
(b) aligning the sheets;
(c) ink jet printing the first face of each of the sheets with up to about thirty six lines of variable data, each line up to about ten inches long;
(d) inverting the sheets;
(e) ink jet printing the second face of each of the sheets with up to about thirty six lines of variable data, each line up to about ten inches long;
(f) rotating each of the documents about 90° about a vertical axis; and
(g) folding the sheets to produce printed, folded business forms;

each of steps (a)–(g) being practiced at essentially the same speed, and at about 400 documents per minute or more.

13. A method as recited in claim 12 wherein each of the sheets is a single ply sheet.

14. A method as recited in claim 12 wherein the sheets of paper have adhesive patterns thereon, and comprising the further step (h) of sealing the folded sheets into mailers by activating the adhesive patterns thereon, step (h) being practiced at essentially the same speed as steps (a)–(g).

15. A method as recited in claim 12 wherein the sheets of paper have non-variable printing thereon, and wherein steps (a)–(g) are practiced to produce business forms selected from the group consisting of IRS 1099 forms, statements, notices, and advertisements.

16. A mechanically, electrically, and control-integrated system comprising a plurality of components physically located immediately adjacent each other, in sequence, each component capable of performing its function at a speed of greater than 200 documents per minute, comprising the following components:

a sheet feeder for feeding sheets;
a sheet aligner for accepting the sheets from the sheet feeder and accurately aligning them and feeding the sheets after aligning them;
a fast non-impact print section for printing sheets fed from the sheet aligner with variable data and discharging the sheets after printing;
an inverter for inverting sheets discharged by the fast print section, and feeding the sheets after inverting;
a second non-impact print section for printing sheets from the inverter with variable data and feeding the sheets after printing; and
a folder for folding printed sheets from the second print section; and further comprising:
a computer control for controlling all of said components so that they operate at approximately the: same speed, greater than 200 documents per minute.

17. A system as recited in claim 16 further comprising the further component of a forms rotator disposed between said second print section and said folder for rotating documents from the second print section approximately 90° about a vertical axis.

18. A system as recited in claim 16 further comprising the further component of a sealer disposed immediately after the folder.

19. A system as recited in claim 16 wherein the first and second print sections comprise ink jet print heads.

20. A system as recited in claim 19 wherein the ink jet print heads are capable of printing at least about thirty six lines of print, each line up to about ten inches long.

* * * * *